US006848744B1

(12) United States Patent
Raftery et al.

(10) Patent No.: US 6,848,744 B1
(45) Date of Patent: Feb. 1, 2005

(54) CHAIR BACK AND CHAIR FORMED THEREWITH

(75) Inventors: William B. Raftery, Canton, OH (US); John H. Heyder, Orleans, IN (US)

(73) Assignee: Paoli, Inc., Orleans, IN (US)

( * ) Notice: Subject to any disclaimer, the term of this patent is extended or adjusted under 35 U.S.C. 154(b) by 43 days.

(21) Appl. No.: 10/170,534

(22) Filed: Jun. 13, 2002

Related U.S. Application Data

(60) Provisional application No. 60/318,561, filed on Sep. 11, 2001, and provisional application No. 60/297,812, filed on Jun. 13, 2001.

(51) Int. Cl.[7] ..... A47C 3/025; A47C 7/14

(52) U.S. Cl. ..... 297/284.1; 297/284.4; 297/284.7

(58) Field of Search ..... 297/284.1, 284.4, 297/284.7, 300.1, 301.7, 300.8, 316, 320

(56) References Cited

U.S. PATENT DOCUMENTS

| | | | | |
|---|---|---|---|---|
| D273,916 | S | 5/1984 | Murry | |
| D346,279 | S | 4/1994 | Stumpf et al. | |
| D386,023 | S | 11/1997 | Stumpf et al. | |
| D391,424 | S | 3/1998 | Raftery | |
| D406,475 | S | 3/1999 | Shovlowsky | |
| D407,911 | S | 4/1999 | Bräuning | |
| 5,988,746 | A | 11/1999 | Raftery | |
| D418,316 | S | 1/2000 | Vogtherr | |
| D420,523 | S | 2/2000 | Stumpf et al. | |
| D422,806 | S | 4/2000 | Neil | |
| D423,259 | S | 4/2000 | Grove | |
| D431,400 | S | 10/2000 | Grove | |
| D440,419 | S | 4/2001 | Röder | |
| D445,581 | S | 7/2001 | Su | |
| 6,257,665 | B1 * | 7/2001 | Nagamitsu et al. | 297/284.1 X |
| D446,955 | S | 8/2001 | Zemp | |
| D449,174 | S | 10/2001 | Neil | |
| D451,293 | S | 12/2001 | Su | |
| D453,079 | S | 1/2002 | Ma | |
| D456,626 | S | 5/2002 | Su | |
| 6,386,634 | B1 | 5/2002 | Stumpf et al. | |
| 6,523,898 | B1 * | 2/2003 | Ball et al. | 297/320 X |
| 6,572,190 | B2 * | 6/2003 | Koepke et al. | 297/284.4 |

OTHER PUBLICATIONS

JDS International, Special NeoCon 2000 brochure, Chair as marked, Executive Chairs .

U.S. patent application Ser. No. 29/142,349 to Raftery filed May 24, 2001 entitled "Chair"page.

* cited by examiner

*Primary Examiner*—Anthony Barfield
(74) *Attorney, Agent, or Firm*—SAIDMAN DesignLaw Group

(57) ABSTRACT

A chair back comprises a back frame, a movable back support, and a contouring assembly. The back frame includes a portion rearward of the back support. The contouring assembly is coupled to the back support and the portion of the back frame. The contouring assembly pulls the back support toward the portion of the back frame. The present invention is also directed to a chair including such a chair back.

24 Claims, 9 Drawing Sheets

CHAIR BACK AND CHAIR FORMED THEREWITH

CROSS-REFERENCE TO RELATED APPLICATION

This application is a non-provisional application claiming priority to prior pending application Ser. No. 60/297,812, filed Jun. 13, 2001, and prior pending application Ser. No. 60/318,561, filed Sep. 11, 2001, which are incorporated by reference herein in their entirety.

BACKGROUND OF THE INVENTION

1. Field of the Invention

The present invention relates to a chair, and more particularly to a back for the chair. The back includes a flexible material and contouring assembly that pulls the flexible material to form the flexible material into a contour that comfortably fits the human body.

2. Description of Related Art

Today, many people spend long hours seated, for example workers at desks. If these people are not seated in a comfortable, well-supported seated posture, they can experience various health problems. Common long-term health problems associated with sitting in uncomfortable positions include back pain, loss of circulation to the feet and legs, numbness, aching legs, and neck stiffness.

For proper seating a chair should allow you to adjust the following features: seat height; seat pan angle; and armrests. The seat pan angle adjustment is not essential to sitting properly. In addition, the chair should be easily rollable on carpet or hard flooring from a seated position. Furthermore, your lumbar area should be in contact with the chair back. In an effort to provide chairs with more comfortable seating, manufacturers have designed chairs that address these concerns.

Lumbar support is of particular interest with respect to the present invention. The lumbar support should be such that the curve of the backrest should support the natural curve of your back. You shouldn't feel too arched or unsupported. If a chair does not provide sufficient lumbar support, you may be able to us a lumbar pillow or towel rolled up to improve fit. These solutions are undesirable however, since the support may shift at times allowing seating position to be incorrect and requiring readjustment, additionally these solutions may look unprofessional.

Chair with adjustable features and a lumbar support is described in U.S. Pat. No. 6,386,634 B1 to Stumpf et al. This chair allows for the above-identified adjustments. The lumbar support, as shown in FIGS. 19 and 20, bears against the backrest membrane and provides a surface area for supporting the user's back. The lumbar support is made of a semi-rigid material such as rubber. This chair and lumbar support, however, have complex designs.

The present invention was developed in an effort to provide a comfortable chair, particularly a chair with a comfortable back support that is easy to manufacture.

SUMMARY OF THE INVENTION

The invention is a chair back with a contouring assembly that pulls a back support rearward toward a spaced cross-brace. The inventive chair back comprises a frame, a movable back support, and the contouring assembly movable back support is supported by a portion of the frame rearward of the back support. The contouring assembly is coupled to the back support and the portion of the frame, and pulls the back support toward the portion of the frame. Furthermore, a portion of the back support can be spaced from the cross-brace.

In one embodiment, the back support is formed of a flexible material selected from the group comprising: fabric, mesh, and leather. In another embodiment, the back support includes a base material and an additional sheet of material. In such an embodiment the back support may further include padding.

According to one feature of the present invention the contouring assembly includes a coupler. According to another feature of the present invention, the back support is formed of a first flexible material and the coupler is formed of a second flexible material.

According to yet another feature of the present invention, the contouring assembly further includes a pair of spaced apart stays. Each stay includes a front surface and a rear surface. The front surface is connected to the back support and the rear surface includes a longitudinally extending slot for slidably receiving the coupler.

The frame may include a pair of spaced apart vertical side bars, a cross-brace extending between the vertical side bars. In such a back, according to another feature of the present invention, the contouring assembly further includes a connector for joining the coupler to the cross-brace. The connector may have an adjustable length. Additionally, the connector may include a flanged plug connected a fish-hook shaped catch or a flanged plug connected a U-shaped hook capable of being opened and closed.

The present invention is also directed to a chair incorporating such a chair back. The chair comprises a base, a seat supported by the base, and the above-described chair back with contouring assembly. The chair may or may not include arms and the arms, seat, and back can be adjustable or fixed.

The present invention is also directed to a chair back comprising a frame, a movable back support, and a contouring assembly. The contouring assembly is movably coupled to the back support and the portion of the frame, and pulls the back support toward the portion of the frame. Furthermore, when a user's back contacts the back support the coupler can move vertically.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
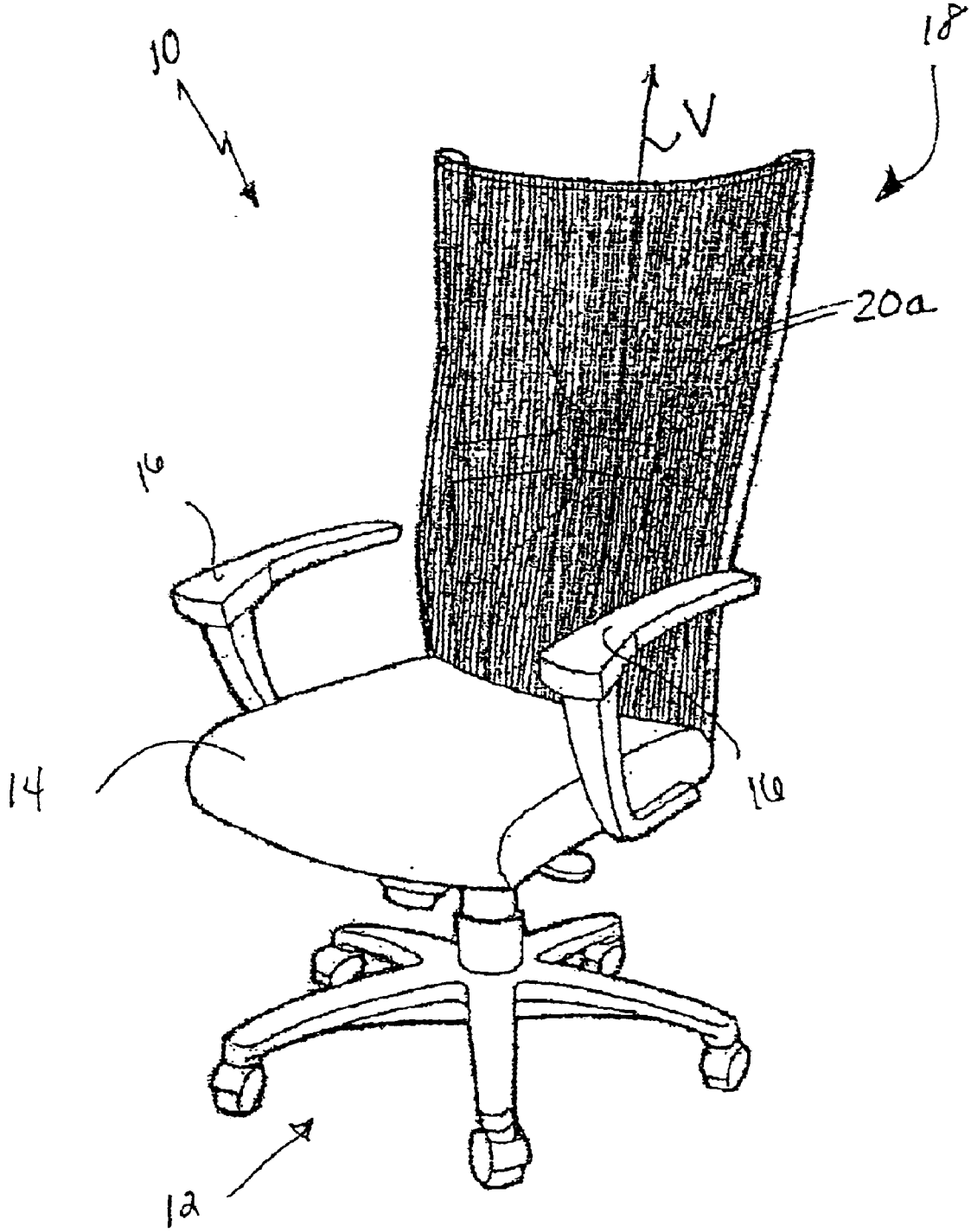
FIG. 1 is a front perspective view of a chair, which includes a first preferred embodiment of the chair back of the present invention.

Referring now to the drawings, wherein like reference numerals represent identical or corresponding parts throughout the several views, and more particularly to FIGS. 1–10 thereof, a chair with a chair back of the present invention is indicated generally by reference numeral 10.

Referring to FIG. 1, an exemplary chair 10 is shown. Chair 10 comprises base 12, seat 14, arms 16, and back 18. Base 12, seat 14, and arms 16 are conventional in function and are shown to provide context for discussion of back 18. The present invention is not limited to any particular base 12, seat 14, and arms 16 and can include components known by those of ordinary skill in the art. The selected components can allow for adjustment of the seat height and arm position. Chair back 18 incorporates the principles and concepts of the present invention.

Figure 2:
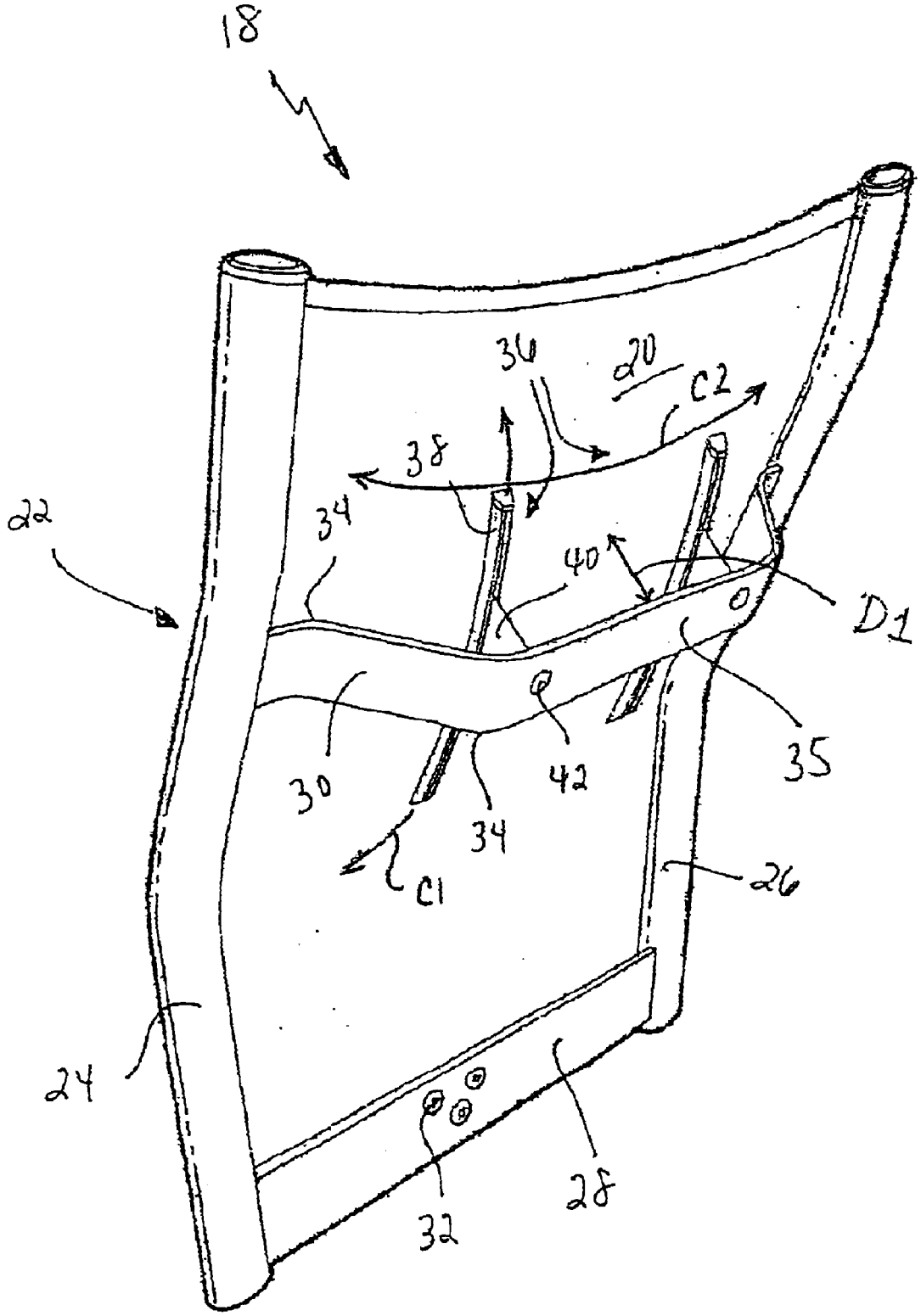
FIG. 2 is a rear perspective view of a chair back of FIG. 1 showing a preferred contouring assembly for pulling a sheet-like backrest material rearwardly.

The construction of chair back 18 is most clearly seen in the rear perspective view of FIG. 2 and comprises a back support or rest 20 spanning a frame 22. The structural integrity of back 18 is derived primarily from frame 22 which comprises a pair of spaced vertical side bars 24 and 26, a lower cross-brace 28, and an intermediate cross-brace 30. Frame 22 is constructed from extruded aluminum, but could alternatively be construction from any suitable rigid, weight-bearing material, such as stainless steel or a plastic having high strength characteristics, such as ABS or polycarbonate. Constructing frame 22 of a combination of materials is also within the scope of the present invention.

Vertical side bars 24 and 26 are shown in FIG. 2 as tubes whose cross-sectional shapes are rounded and generally elliptical. When rigidly joined together, vertical side bars 24 and 26 diverge slightly and curve rearwardly from bottom to top, as is customary in high back chairs of the type shown in FIG. 1. The vertical side bars 24 and 26 define a central vertical axis V, as shown in FIG. 1, which is midway the side bars as measured from the lower ends of the bars.

The general vertical contours of back 18 are determined by the curvatures of vertical side bars 24 and 26, which are shaped ergonomically to provide comfort to the intended users. Of course, side bars 24 and 26 could take on many other cross-sectional shapes (e.g., rectangular, square, circular, etc.), contours, and/or relative orientations (e.g., parallel, converging, or irregular) to suit the particular application of the chair with which back 18 is to be used.

Lower cross-brace 28 is fixed at its opposite ends to the two vertical side bars 24 and 26 by any suitable method of rigidly joining them, such as welding, braising, or bonding. In addition, fasteners can be used to join these components. Apertures 32 for fasteners, such as hex-head bolts (not shown), are provided for coupling back 18 to seat 14 (as shown in FIG. 1) using a conventional bracket (not shown). The present invention is not limited to this type of connection and any other conventional configuration and methods can be used to couple back 18 to seat 14.

Intermediate cross-brace 30 extends between the vertical side bars 24 and 26 and is also fixed at its opposite ends to the two vertical side bars 24 and 26. The intermediate cross-brace is located between the ends of the vertical side bars 24 and 26. The intermediate cross-brace is generally arcuately shaped, as shown. The relatively sharp bends 34 shown are not critical, as intermediate cross-brace 30 could be smoothly arcuate as well, or of any desired curvature. Alternatively, the intermediate cross-brace 30 may be more sharply bent so that the different sections of the cross-brace 30 are perpendicular to one another. The preferred characteristic of intermediate cross-brace 30 is that it bow rearwardly relative to chair 10, so that the central portion 35 of cross-brace 30 is located sufficiently rearward of vertical side bars 24 and 26, when integrally connected thereto, so that the functions described below can performed. The distance between the central portion 35 and the back support at rest is designated D1 in FIG. 2. This is the maximum distance of the cross-brace 30 from the back support at rest.

Back support 20 preferably comprises a flexible material that is sheet-like, for example a preferred material is a fabric. This fabric can be woven, knitted or non-woven, such as knitted mesh fabric made of cotton or Nylon™ material. Mesh fabric is preferred for back support 20 because it provides the tensile strength necessary for the present invention and has perforations 20*a* (as shown in FIG. 1) that allow air flow therethrough. The perforations minimize the heat generated between the back of a user and the support 20, when the user is resting against support 20. Obviously, any strong, flexible sheet-like material, such as a non-porous nylon fabric or leather, for example, could be substituted for the preferred knitted mesh fabric. One preferred material is a two-way stretch polyester blend commercially available from Matrex in Greensboro, N.C. under the name W-09 webbing. However, other two-way or one-way stretch materials can be used.

Figure 2A:
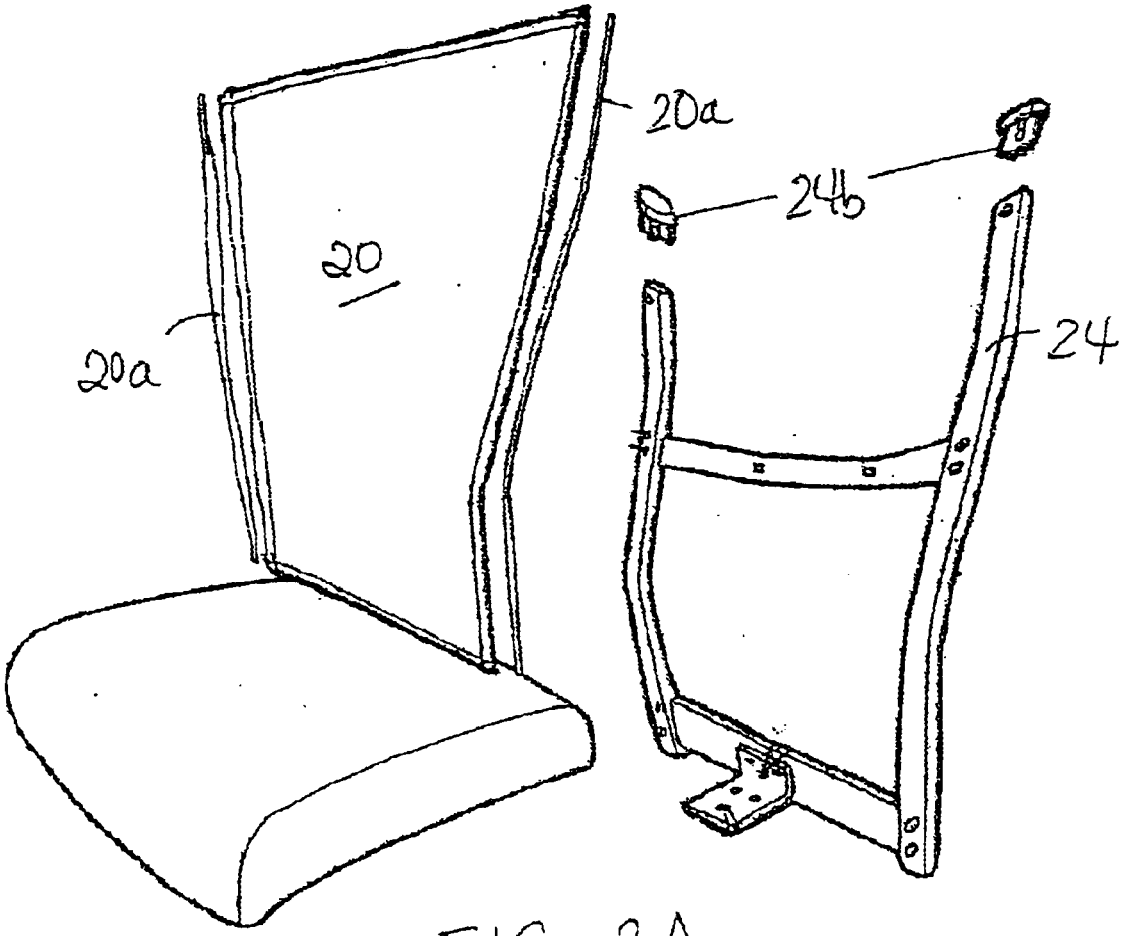
FIG. 2A is a front, exploded, perspective view of a portion of the chair back of FIG. 1
Figure 2B:
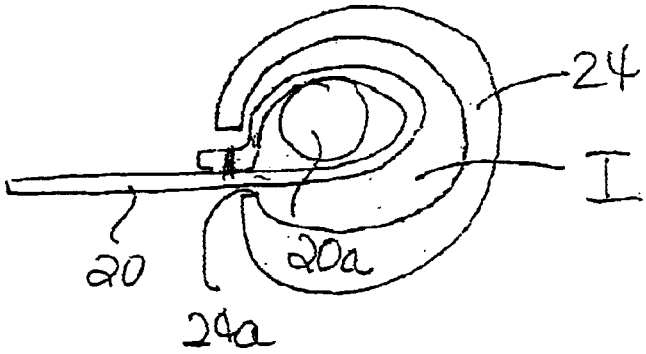
FIG. 2B is an enlarged, top view of the flexible material, welt cord and vertical support as shown in FIG. 2A in an assembled state.

Support 20 is attached to at least frame members 24 and 26, but can also be attached to lower cross-brace 28. A mechanical attachment is used to join the support 20 to the frame. Referring to FIGS. 2A and 2B, in a preferred embodiment, this mechanical attachment is achieved by folding the vertical edges of the support material 20 over two pieces of welt cord 20*a*. The support material 20 is then stitched to retain the welt cord 20*a* thereto. A vertical slot 24*a* is formed on the inner surface of the vertical supports 24 and 26. The slot and welt cord are configured and dimensioned to retain the welt cord within the interior I of the supports and so that the material 20 extends through the vertical slot. The open ends of the vertical supports are capped with optional end caps 24*b*. One preferred welt material is commercially available from PETCO in Michigan and is a 5/32" black foam welt. Preferably, the welt material is a solid cylindrical polypropylene, however the present invention is not limited hereto and reinforced or hollow welt materials of various shapes can also be used. Optionally, mechanical fasteners such as staples or bolts can be joined to the vertical supports to prevent the mesh and welt cord from moving vertically within the supports. The present invention is not limited to these attachment techniques and any other convenient ones can also be used, such as using mechanical fasteners, welding, bonding or sandwiching the flexible material between frames can be used to join the material to the frame.

The width of each vertical segment of back support 20 is slightly greater than the corresponding distance between vertical side bars 24 and 26, so that back support 20 is under tension in a side-to-side or transverse direction. The desired tension allows the support 20 to be stretched taught so that there is no wrinkling, bunching, or gathering of the surface of the material. The tension will vary depending on the flexible material used among other factors. This tension will also allow the support 20 to have a certain amount of resiliency, which provides formfitting comfort to the user.

Figure 3:
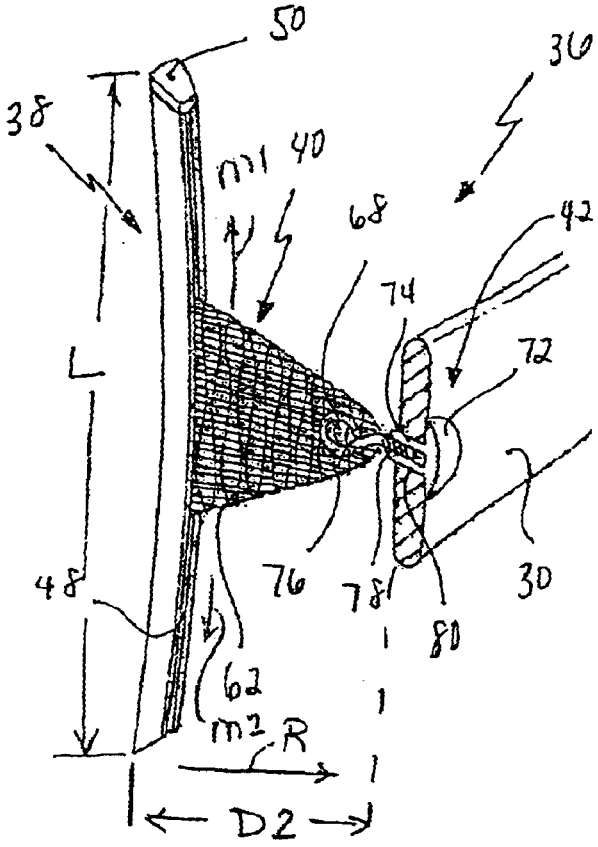
FIG. 3 is a partial perspective view, with a portion in cross-section, of the contouring assembly of FIG. 2 including a first embodiment of a connector or "pull-back retainer"

The chair back 18 further includes a pair of contouring assemblies 36 (as shown in FIGS. 2–3), each of which comprises a stay 38, a coupler 40, and a connector 42. Each contouring assembly 36 pulls support 20 rearwardly, as illustrated by arrow R (in FIG. 3), to form a concave, arcuate surface, when viewed from the front as in FIG. 1. The rearward pull of the contouring assemblies also exerts tension on support 20. This tension will vary depending on the material used the configuration and dimension of the couplers, vertical members and intermediate cross member. One exemplary chair back has assemblies that exert a force of about 10 to about 15 pounds and pulls the material back between about 1 and about 3 inches. The present invention is not limited to these values.

Referring to FIG. 2, the contouring assemblies 36 form a vertical curvature C1 and a transverse curvature C2. The contouring assemblies 36 and cross-brace 35 can be configured, dimensioned and positioned so that the curvature C1 supports the user's back in the lumbar area and the curvature C2 supports the user's back in the thoracic area. The present invention is not limited hereto and can be configured and dimensioned to support various areas of the user's back. Due to the shape of the vertical supports in the present embodiment, the pull of the contouring assembly causes the vertical curvature to have an S shape so that while the upper portion of the support moves rearwardly the lower portion of the support moves forwardly. Preferably, the vertical center of the intermediate cross member is about 15 to about 16 inches above a compressed seat cushion height so that the pulls are located to conform to the thoracic area of a user's back.

Preferably, the contouring assemblies are located on opposite sides of the central vertical axis in the area of an average user's scapula bones. However, the present invention is not limited to this configuration and any number of contouring assemblies can be used such as a single one to five or more. Additionally, although the contour assemblies are shown as vertically extending, horizontally extending contour assemblies can also be used. With horizontally extending assemblies an I-shaped frame is preferably used (with two spaced horizontally extending frame members joined by a vertically extending frame member), and the contouring assemblies connect to the vertically extending beam of the I-shaped frame. The length of the coupler should allow the flexible material to be pulled rearwardly but does not allow the user's back when in contact with the material to contact the intermediate cross member.

Referring again to FIGS. 3 and 4, stay 38 is preferably an extruded strip of a plastic material having a hollow interior 44, which is open at both ends 46. Slot 48 extends the full length of the rear of stay 38 and provides a continuous opening through the rear side wall into hollow interior 44. A pair of optional caps 50 (only one shown) is provided to close ends 46 when stay 38 is in use. A preferred cross-sectional shape of stay 38 is shown in FIG. 5, in which stay 38 is generally trapezoidal with a substantially flat front surface 52, a pair of converging arms 54 and 56, and a pair of inwardly directed prongs 58 and 60 which define rear slot 48. The rear slot 48 has a width Ws. The stay is not limited to this configuration and others may be used. An alternative embodiment of stay 38 will be outlined shortly when the functional requirements of stays 38 in contouring back support 20 are more completely understood.

Figure 6:
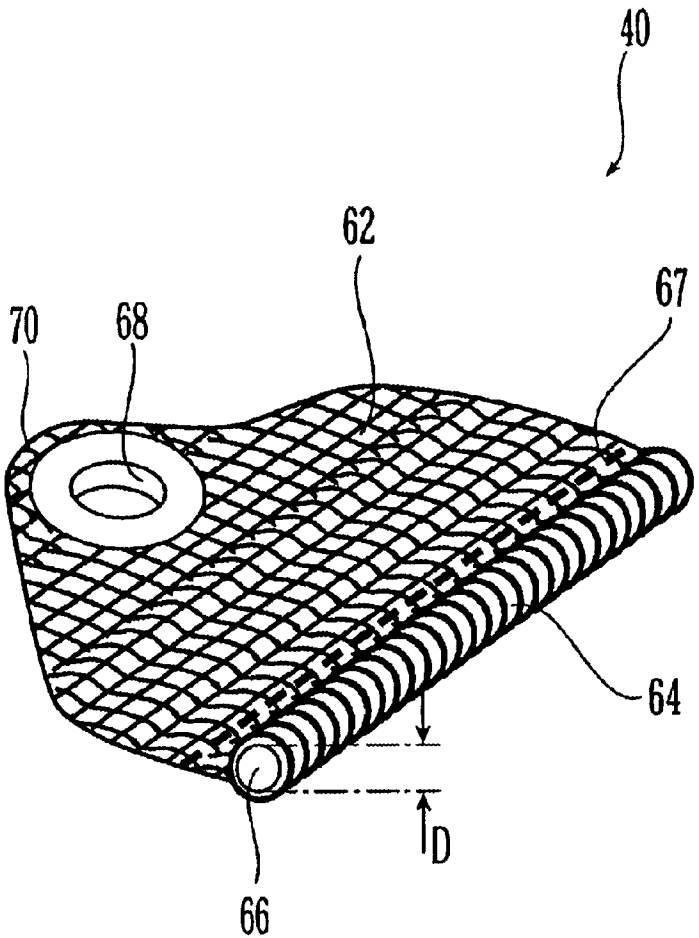
FIG. 6 is an enlarged perspective view of the coupler of the contouring assembly of FIGS. 2 and 3.

Referring to FIGS. 3 and 6, coupler 40 includes a sheet of flexible material 62. Preferably, the coupler 40 is formed of a different material from back support 20 (e.g., mesh), but in another embodiment the coupler 40 can be formed of a flexible material the same as that of the back support. In this embodiment, the coupler 40 has a short, generally triangular shape. One preferred but non-limiting material is commercially available from DUPONT under the name Top Gun and is a tightly woven nylon. The bottom or front edge 64 of material 62 is wrapped around a cylindrical plastic rod 66 (FIG. 6) and sewn with stitches 67 to constrain rod 66 therewithin. In an alternative embodiment, the coupler can have a diamond shape and a piece of welt cord sandwiched within the folded diamond shape. Once folded the coupler has a triangular shape similar to that shown. The welt cord can be secured therein using two-sided tape such as 3M transfer tape or sewing. The grommet can be connected through the narrow point of the diamond.

The rod 66 has a diameter D. The coupler 40 further includes an open grommet 68 adjacent an apex 70 of the triangular coupler 40. The grommet 68 is a reinforcement to the material 62 formed of metal to include a central tube and flanges. When the flanges are bent they are wider than the hole in the material so that the grommet 68 is secured to the material 62, as known by one of ordinary skill in the art.

Referring back to FIG. 3, the connector 42 of contouring assembly 36 comprises in combination a flanged plug 72 with a hollow threaded stem 74 and a fish-hook shaped catch 76 with a threaded shaft 78. Preferably the fish-hook catch 76 is formed of metal. However, another material satisfying the necessary strength requirements of the catch can also be used.

Referring to FIGS. 2 and 5, in use, stays 38 are stitched through flat front surface 52 to back support 20. In order to allow the stitching operation to be effected, the plastic that forms stays 38 is preferably soft enough to be penetrated by a needle, but sufficiently hard enough to prevent the stitching from pulling through stay 38.

Preferably, the width Ws of slot 48 is large enough to allow passage of the needle. When sewn to support 20, flat front surface 52 presents a smooth surface to the back of the user. Stays 38 are also preferably soft enough to be capable of bending slightly under pressure such that its longitudinal shape along longitudinal axis L (as shown in FIG. 4) has vertical contour C1 (see FIG. 2) to generally follow the contours of the user's back when leaning against back support 20.

Figure 4:
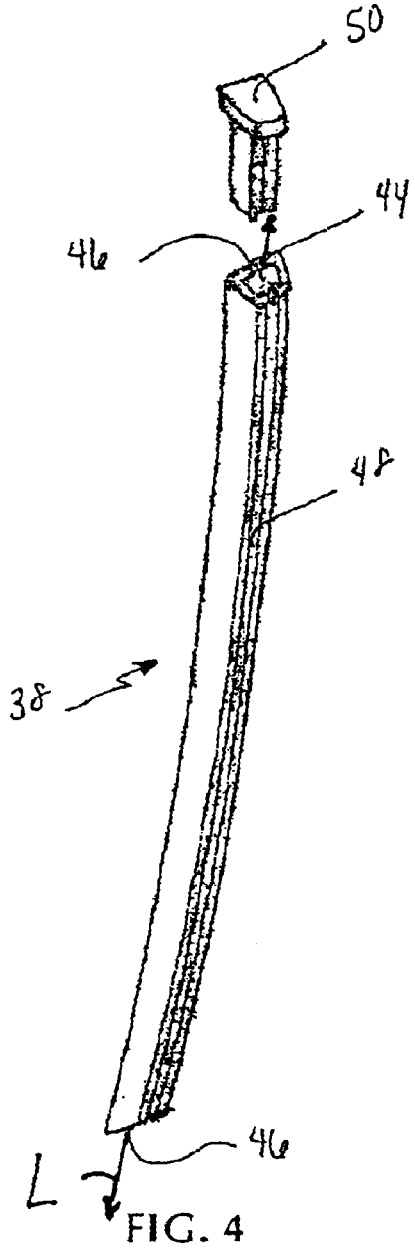
FIG. 4 is an enlarged perspective view of a stay of the contouring assembly of FIGS. 2 and 3.
Figure 5:
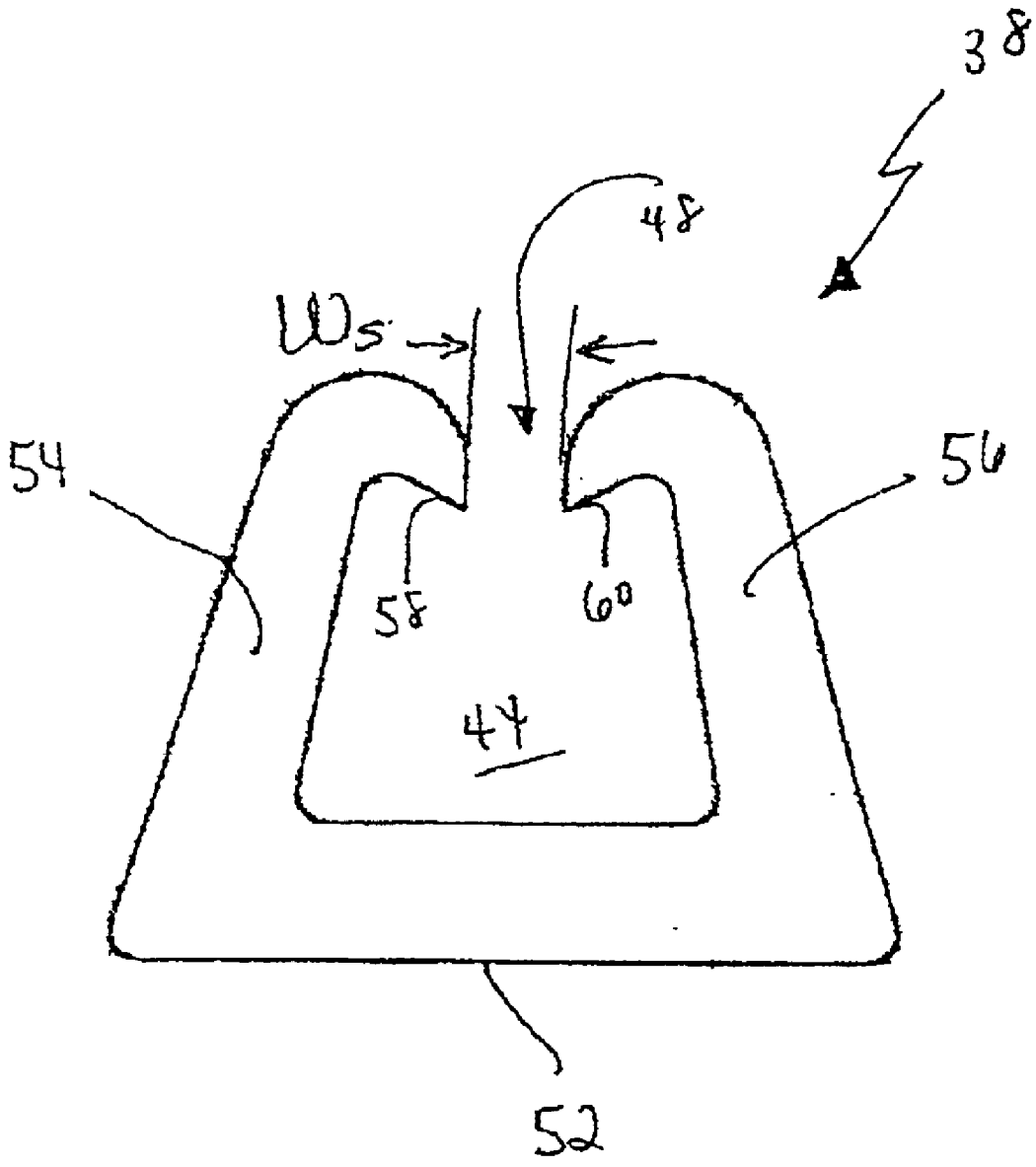
FIG. 5 is a top view of the stay of FIG. 4.

Referring to FIGS. 3–4 and 6, plastic rod 66 and base 64 of coupler 40 are inserted longitudinally through open end 46 of stay 38 with the triangular sheet 62 extending through slot 48. Coupler 40 is thereafter slid interiorly along stay 38 to a position opposite intermediate cross-brace 30 where it is frictionally held in place.

The diameter D of rod 66 is greater than slot width Ws so that the rod 66 is retained within stay 38. The diameter D is sized so that the rod 66 is capable of sliding longitudinally within hollow interior 44 of stay 39, but such that there is friction between the stay 38 and coupler. The caps 50 close ends 46 of stays 38 and restrict the longitudinal sliding movement of the coupler 40.

Referring to FIG. 3, flanged plug 72 is inserted through an aperture 80 in intermediate cross-brace 30 and threaded shaft 78 of fish-hook shaped catch 76 is threaded into hollow stem 74 of plug 72. Catch 76 is hooked through grommet 68 to connect coupler 40 and thereby stay 38 and back support 20 to intermediate cross-brace 30. The dimensions of stays 38, couplers 40, and connectors 42 along with the positioning of contouring assemblies 36 are such that back support 20 is pulled rearwardly as indicated by arrow R and contoured to the desired configuration for comfortably supporting the back of the user. Coupler material 62 is inextensible so that it pulls back support 20 rearwardly, but it is also flexible which allows a certain amount of give to back support 20 under the weight of the user, a feature not possible with a rigid chair back, adding to the comfort level afforded by the invention. The flexibility of the coupler allows it to bend, flex or collapse when compressed by a user.

Preferably, the dimension of the contouring assembly extending between the front face of the stay (if present) and the inwardly facing surface of the intermediate cross-brace is designated D2 in FIG. 3. In order for the contouring assembly to exert tension on the back support the dimension D2 is less than the distance D1 (shown in FIG. 1). Thus, intermediate cross-brace 30 and components of the contouring assembly 36 should be configured and dimensioned accordingly. Thread length can be used to adjust contour and tension on support. The tension can also be adjusted by changing the length of the coupler or the shape of the intermediate cross-brace.

The vertical contour can also be adjusted by changing the length of the stays and/or the couplers or eliminating the use of stays. The vertical contour can also be adjusted by adjusting the stiffness of the stay material. The transverse contour can be adjusted by varying the spacing between the stays or couplers if there are no stays. When a user sits in the chair, the channels in the stays allow the couplers to move vertically, as illustrated by arrows M1 and M2 (FIG. 2) in two directions, to allow the contours of the chair to adjust to the user based on the user's height and weight.

It can be seen that the length L of stays 38 (see FIG. 3) functions to spread the pull of couplers 40 across an elongated longitudinal area (see FIG. 1) while flat surfaces of front surface 52 are smoothly comfortable against the user's back. Stays 38 must be rigid enough such that prongs 58 and 60 (as shown in FIG. 5) hold couplers 40 securely, i.e., couplers 40 are not released thereby due to the tensional forces imposed by pulling on back support 20. While the cross-sectional shape shown in FIG. 5 meets these requirements, other embodiments are suitable as well. For instance, a circular or preferably oval cross-section would present a smoothly rounded surface against support 20 and the opposite walls surrounding slot 48 would still prevent the escape of rod 66 and sheet 62. In addition, affixing stays 38 to support 20 need only be secure and comfortable, and any known method of attaching the two, such as by adhesives or heat welding, which meets these criteria are within the scope of the invention.

Figure 3A:
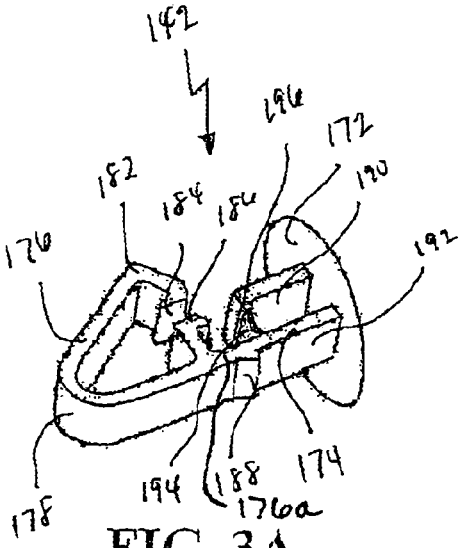
FIG. 3A is an enlarged perspective view showing an alternative preferred embodiment of the connector or "pull-back retainer", wherein the connector is in an opened state.
Figure 3B:
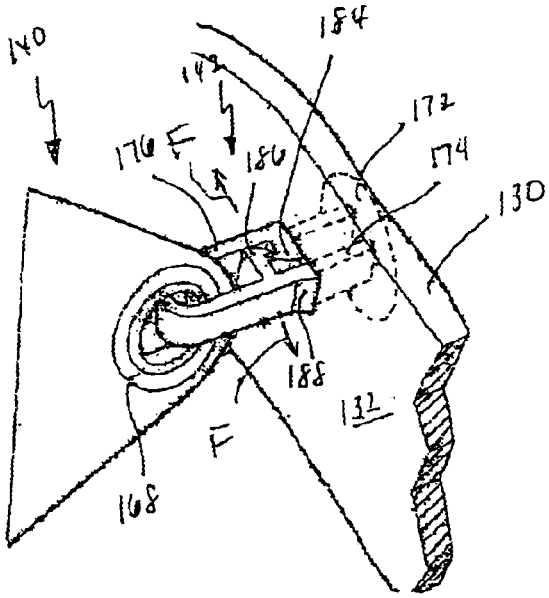
FIG. 3B is an enlarged perspective view showing the connector of FIG. 3A assembled with a first embodiment of a coupler and a cross-brace.
Figure 3C:
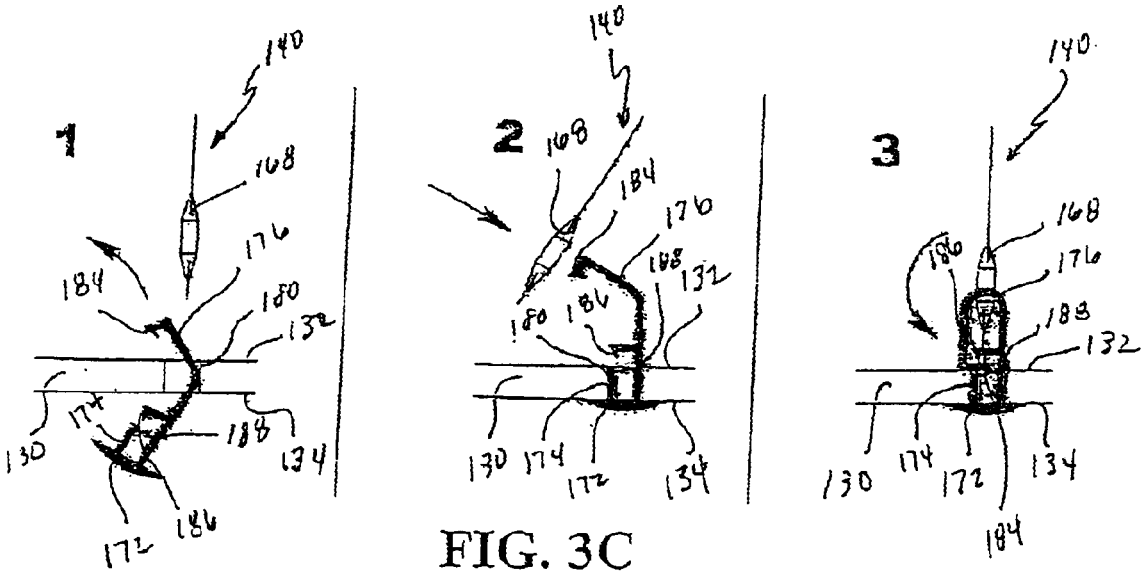
FIG. 3C is a three-step diagram showing the assembly of the connector and the coupler of FIG. 3B.

Referring to FIGS. 3A–3C, a second preferred connector 142 is shown, along with a slightly modified cross-brace 130. Connector 142 is preferably formed entirely of a plastic material, such as nylon and, as will be described in greater detail herein, is easier in install than connector 42. Connecter 142 includes a flanged plug 172 and a hollow stem 174 (comprising two parallel walls 190 and 192) which are structurally identical to the corresponding parts of connector 42. However, instead of metal catch 76 of connector 42, connector 142 includes a U-shaped hook 176 for engaging grommet 168 of coupler 140 (see FIG. 3B). Hook 176 includes a flexible head 178, which allows hook 176 to be opened and closed. The fixed end **176*a* of hook 176 is affixed to and extends from stem 174. The connector is formed by molding as a single, integral piece. The other free end of the hook 176 forms a bent elbow and terminates at a catch 184. When hook 176 squeezed closed, catch 184 interlocks with catch 186, thereby retaining hook 176 in a closed position as shown in FIG. 3B**.

Connector 142 also includes a flexible brace 196 (numbered only in FIG. 3A), which is preferably affixed transversely to stem walls 190 and 192. The center 194 of brace 196 preferably bows slightly in the direction of catch 184.

FIG. 3C shows the three steps required to assemble connector 142. In step 1, hook 176 is flexed open and pulled through aperture 180 of cross-brace 130 until a lip 188 (extending outwardly from stem 174) clears the forward-facing, inner surface 132 of cross-brace 130 and flanged plug 172 is pressed against the rearward-facing, outer surface 134 of cross-brace 130, thereby locking connector 142 in place within cross-brace 130. The bow in center 194 of brace 196 allows walls 190 and 192 to flex inwardly when being inserted through aperture 180.

In this embodiment, aperture 180 is square similar to the general cross-sectional shape of stem 174 to prevent rotation of connector 142 after assembly. Such complementary shaping of the aperture and stem is preferable but optional. In step 2, grommet 168 is placed over hook 176. In step 3, coupler 140 is moved toward connector 142 until the hook 176 extends through the grommet 168. Then, the hook 176 is squeezed closed until catches 184 and 186 interlock thus retaining grommet 168 to hook 176. The brace 194 (shown in FIG. 3A) is configured and dimensioned so that it applies outwardly directed forces F on connector 142, as illustrated in FIG. 3B, to prevent catch 184 from becoming unlocked from catch 186. To open connector 142, inwardly directed forces opposite forces F would have to be applied to connector 142 to disengage catches 184 and 186.

Referring to FIGS. 7–10, a second preferred chair 82 embodiment is shown. Chair 82 comprises a base 84, seat 86, arms 88, and back 90. As discussed above, base, seat, and arms are not a part of the invention per se except in combination therewith and may take on many forms and styles.

Figure 8:
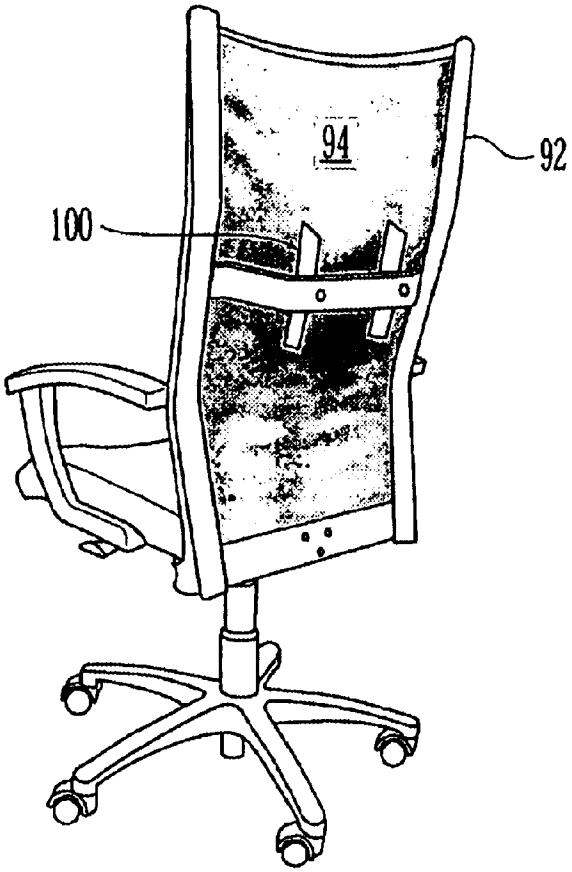
FIG. 8 is a back perspective view of the chair of FIG. 7.
Figure 7:
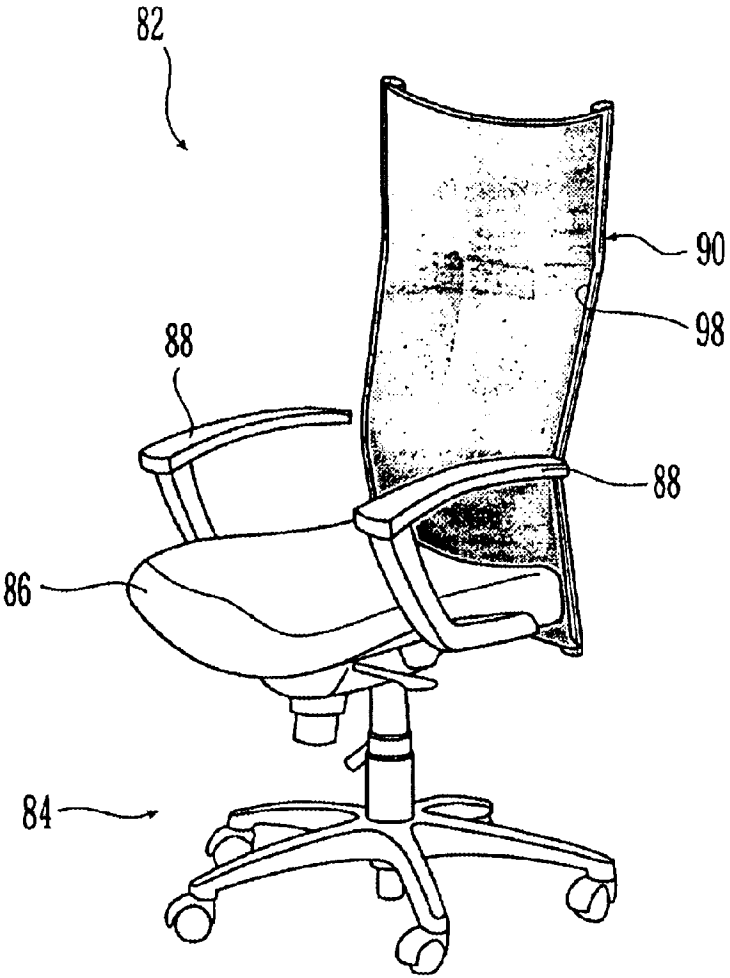
FIG. 7 is a front perspective view of a chair, which includes a second preferred embodiment of the chair back of the present invention.

Referring to FIG. 8, chair back 90 comprises a frame 92, substantially identical to frame 22 previously discussed and a back rest or support 94. Back support 94 differs in this embodiment from the back support 22 (shown in FIG. 1) preferred in the first disclosed embodiment. Support 94 includes a structurally supportive flexible, sheet-like base material or web 96 (FIGS. 9–10) to which a cushion 98 is attached (FIG. 7). The flexible material 96 can be formed as previously discussed. The cushion 98 may simply be an additional sheet of material, such as leather, joined to material 96 or can include material covering or containing padding in the manner of an upholstered chair back.

Figure 10:
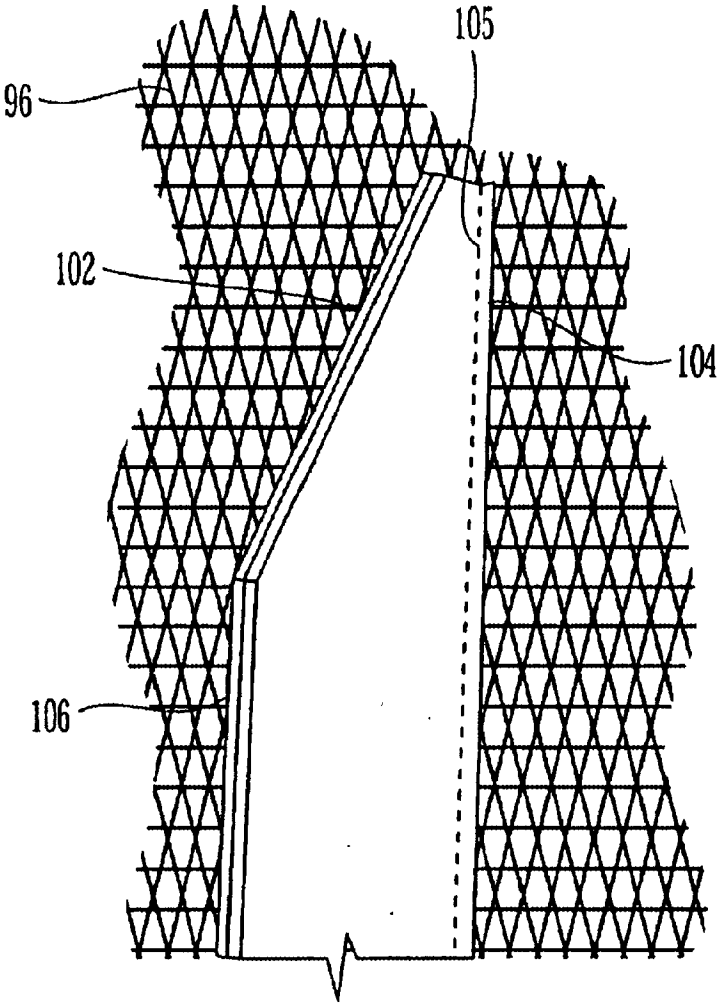
FIG. 10 is a further enlarged view of the coupler of FIG. 9.

Referring to FIGS. 8 and 10, chair back 90 also differs in the nature of the contouring assembly 100. In this embodiment, there is no stay 38 (as shown in FIG. 2). Coupler 102 is made of sheet or sheet-like material 102*a*, e.g., leather, instead of knitted mesh. As clearly seen in FIG. 9, material 102*a* of coupler 102 is sewn directly to web 96 near its bottom edge 104 by stitches 105. FIG. 10 shows in closer detail the stitches 105 joining coupler 102 to support web 96.

The coupler 102 has a rectangular rather than a triangular shape so that the apex present in the previous embodiment has been truncated into a rear edge 106. An open grommet 108 is connected into material 102*a* by any convenient means. The grommet 108 in this case is an additional layer of material to reinforce the hole through coupler 102. The grommet 108 is sewn to material 102*a*. An aluminum disk (not shown) having an aperture that corresponds to hole in the material for the grommet 108 may optionally be sewn inside coupler 102 to provide additional strength around such hole.

Figure 9:
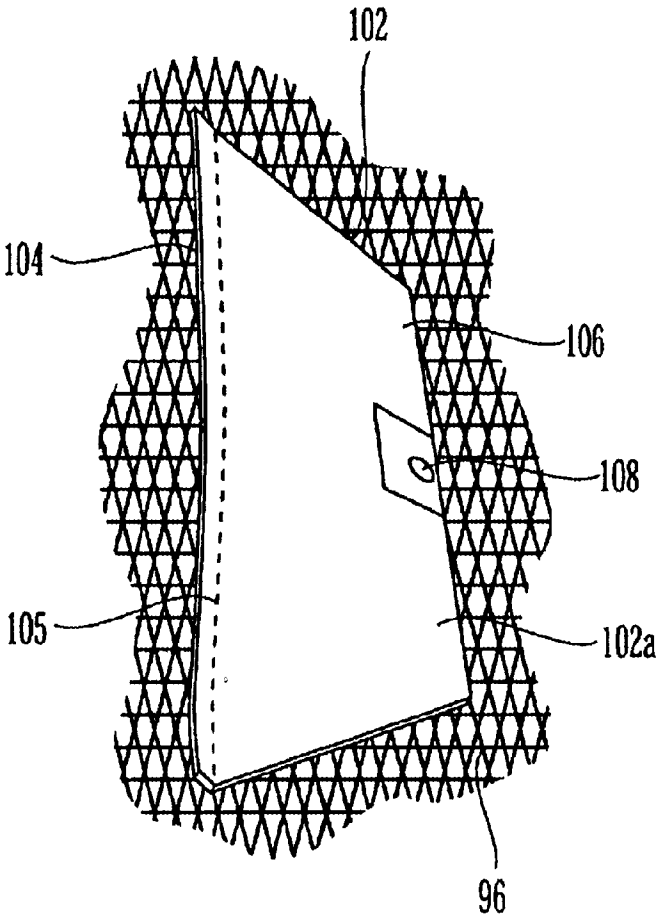
FIG. 9 is an enlarged view of a second preferred embodiment of the coupler as attached to the chair of FIG. 7.

As can be seen in FIGS. 9–10, contouring assembly 100 is simpler than contouring assembly 36 (shown in FIG. 2), but less aesthetically attractive than contouring assembly 36. Contouring assembly 100 is for use with the connectors 42 or 142 described above or any equivalent means of connecting frame 92 to coupler 102.

Those skilled in the art will appreciate that the conception, upon which this disclosure is based, may readily be utilized as a basis for designing other products for carrying out the several purposes of the present invention. It is important, therefore, that the claims be regarded as including such equivalent constructions and modifications insofar as they do not depart from the spirit and scope of the present invention as defined in the appended claims. Therefore, this invention is not to be limited to the specifically preferred embodiments depicted therein. For example, the features of one embodiment disclosed above can be used with the features of another embodiment. Alternatively, the lower cross-brace can: be formed as part of the seat so that the back frame has a H-shape. The frame can also have various other shapes such as I-Shape, X-shape or the like. The present invention is not limited to the shape or location of the various components, such as the shape of the vertical supports or cross-braces or the location of the intermediate cross-brace. Although "high backed" chairs are shown where the top edge of the chair will be at the head height of most users to support the head, the present invention can also be used on "low-backed" chairs where the top edge of the chair back is spaced from a user's head and does not support the majority of user's heads. The invention is a chair back with a contouring assembly that pulls a back support rearwardly to contour the upper and lower back areas of the material in various directions front, back, vertically, and side-to-side or three dimensions. Thus, the details of these components as set forth in the above-described preferred embodiment, should not limit the scope of the present invention.

Further, the purpose of the Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. A chair back comprising:

a movable back support including a first end, a spaced apart second end and an intermediate area spaced from the first and second ends, said back support being formed of a first flexible material;

a frame supporting said back support and including an intermediate portion rearwardly spaced from said back support adjacent said intermediate area;

a contouring assembly extends between said intermediate area of said back support and said intermediate portion of said frame, said contouring assembly being formed of a second flexible material and said contouring assembly pulls said back support rearwardly toward said intermediate portion of said frame, wherein under a user's weight the intermediate area of the back support moves toward the intermediate portion of the frame and the contouring assembly flexes.

2. The chair back of claim 1, wherein a first length extends between a rear surface of said back support and a forward surface of said intermediate portion and said contouring assembly having a second length that extends between said rear surface of said back support and said forward surface of said intermediate portion, said second length being less than said first length so that said contouring assembly pulls said back support toward said intermediate portion of said frame.

3. The chair back of claim 1, wherein said back support includes a base material and an additional sheet of material.

4. The chair back of claim 3, wherein said base material and said additional sheet of material are selected from the group comprising: fabric, mesh, and leather; and wherein said back support further includes padding.

5. The chair back of claim 1, wherein said contouring assembly includes a coupler.

6. The chair back of claim 1, wherein said contouring assembly further includes a coupler formed of a said second flexible material.

7. The chair back of claim 6, wherein said first flexible material and said second flexible material are the same.

8. The chair back of claim 7, wherein said first and second flexible materials are selected from the group comprising: fabric, mesh, and leather.

9. The chair back of claim 6, wherein said first flexible material and said second flexible material are different.

10. The chair back of claim 1, wherein said frame further includes a pair of spaced apart vertical side bars and a cross-brace extending between said vertical side bars.

11. The chair back of claim 10, wherein each of said vertical side bars include spaced apart first and second ends, and wherein said cross-brace is located between said first and second ends.

12. The chair back of claim 10, wherein said cross-brace has a rearwardly bowed shape.

13. The chair back of claim 10, wherein said contouring assembly further includes a coupler and a connector for joining said coupler to said cross-brace.

14. The chair back of claim 13, wherein said connector has an adjustable length.

15. The chair back of claim 13, wherein said connector includes a flanged plug connected to a fish-hook shaped catch.

16. The chair back of claim 13, wherein said connector includes a flanged plug connected to a U-shaped hook capable of being opened and closed.

17. A chair back comprising:

a movable back support formed of a first flexible material;

a frame supporting said movable back support and including a portion rearwardly spaced from said back support;

a contouring assembly coupled to said back support and said portion of said frame, said contouring assembly pulling said back support rearwardly toward said portion of said frame, said contouring assembly includes a coupler formed of a second flexible material, and said coupler is movably connected to said back support, wherein said first flexible material and said second flexible material are different.

18. A chair back comprising:

a movable back support;

a frame supporting said movable back support and including a portion rearwardly spaced from said back support;

a contouring assembly coupled to said back support and said portion of said frame, said contouring assembly pulling said back support rearwardly toward said portion of said frame, said contouring assembly further includes a coupler and a pair of spaced apart stays, each stay including a front surface and a rear surface, said front surface being connected to said back support and said rear surface including a longitudinally extending slot for slidably receiving said coupler and allowing said coupler to move within said slot.

19. The chair back of claim 18, wherein said stays are formed of a bendable material.

20. A chair comprising:

a base;

a seat supported by said base; and a chair back supported by said seat and including a movable back support including a first end, a spaced apart second end and an intermediate area spaced from the first and second ends, said back support being formed of a first flexible material;

a frame supporting said back support and including an intermediate portion rearwardly spaced from said back support adjacent said intermediate area;

a contouring assembly extends between said intermediate area of said back support and said intermediate portion of said frame, said contouring assembly being formed of a second flexible material and said contouring assembly pulls said back support rearwardly toward said intermediate portion of said frame wherein under a user's weight the intermediate area of the back support moves toward the intermediate portion of the frame and the contouring assembly flexes.

21. The chair of claim 20, further including arms supported by said seat.

22. The chair of claim 20, wherein said frame further includes a pair of spaced apart side bars and a cross-brace extending between said sidebars, and said contouring assembly further includes a coupler and a connector joining said coupler to said cross-brace.

23. The chair of claim 20, wherein said contouring assembly further includes a coupler, and said coupler is formed of a said second flexible material.

24. The chair of claim 23, wherein first and second flexible materials are mesh.

* * * * *

UNITED STATES PATENT AND TRADEMARK OFFICE

CERTIFICATE OF CORRECTION

PATENT NO. : 6,848,744 B1 
DATED : February 1, 2005
INVENTOR(S) : William B. Raftery and John H. Heyder It is certified that error appears in the above-identified patent and that said Letters Patent is hereby corrected as shown below:

Column 10,
Lines 32-33, should read
6. The chair back of claim 1, wherein said contouring assembly further includes a coupler formed of said second flexible material.

Column 12,
Lines 23-25, should read
23. The chair of claim 20, wherein said contouring assembly further includes a coupler, and said coupler is formed of said second flexible material.

Signed and Sealed this

Seventeenth Day of May, 2005

JON W. DUDAS
*Director of the United States Patent and Trademark Office*